US009675997B2

(12) United States Patent
Lindgren et al.

(10) Patent No.: US 9,675,997 B2
(45) Date of Patent: Jun. 13, 2017

(54) DEVICE FOR, OR IN, THE SURFACE TREATMENT OF OBJECTS

(71) Applicant: Caraway AB c/o Nääs & Co., Floda (SE)

(72) Inventors: Patrik Lindgren, Sundsvall (SE); Magnus Nygren, Göteborg (SE); Melker Larsson, Gråbo (SE)

(73) Assignee: Caraway AB, Floda (SE)

( * ) Notice: Subject to any disclaimer, the term of this patent is extended or adjusted under 35 U.S.C. 154(b) by 0 days.

(21) Appl. No.: 14/898,303

(22) PCT Filed: Jun. 5, 2014

(86) PCT No.: PCT/SE2014/050682
§ 371 (c)(1),
(2) Date: Dec. 14, 2015

(87) PCT Pub. No.: WO2014/200418
PCT Pub. Date: Dec. 18, 2014

(65) Prior Publication Data

US 2016/0136684 A1 May 19, 2016

(30) Foreign Application Priority Data

Jun. 13, 2013 (SE) ..... 1350728

(51) Int. Cl.
*B05D 3/00* (2006.01)
*B05D 3/06* (2006.01)
(Continued)

(52) U.S. Cl.
CPC ..... *B05D 3/067* (2013.01); *B05D 3/0263* (2013.01); *B05D 3/065* (2013.01); *F26B 3/30* (2013.01); *F26B 2210/12* (2013.01)

(58) Field of Classification Search
CPC ..... B05D 3/067; B05D 3/065; B05D 3/0263; F26B 3/30; F26B 2210/12
(Continued)

(56) References Cited

U.S. PATENT DOCUMENTS 4,416,068 A 11/1983 Nilsson et al.
4,662,086 A 5/1987 Hennecke et al.
(Continued)

FOREIGN PATENT DOCUMENTS

CN 2712478 Y 7/2005
EP 0826431 A1 3/1998
(Continued)

OTHER PUBLICATIONS

Swedish Patent and Registration Office, Int'l Search Report in PCT/SE2014/050682, Sep. 2, 2014.

*Primary Examiner* — Michael Maskell
(74) *Attorney, Agent, or Firm* — Piedmont Intellectual Property

(57) ABSTRACT

A device for surface treatment of an object on a workstation surface has a support frame movable in relation to the object and a number of irradiation elements and a control unit for controlling the irradiation. The support frame is movable in at least one direction along the object, surrounds the object on at least two sides, and includes two substantially parallel side sections and an upper section connected with at least one of the side sections. The object is disposed between the side sections and under the upper section. Each side section includes at least one movable, adjustable panel. On the upper section, a movable panel having irradiation elements is arranged. Some of the panels have infrared and ultraviolet sources. Sensor elements sense the position of the object,
(Continued)

and are connected with the control unit, which can control position and/or angular setting of the panels and/or irradiation elements.

19 Claims, 7 Drawing Sheets

(51) Int. Cl.
*F26B 3/30* (2006.01)
*B05D 3/02* (2006.01)

(58) Field of Classification Search
USPC ..... 250/504 R, 453.11–455.11
See application file for complete search history.

(56) References Cited

U.S. PATENT DOCUMENTS

| | | | | |
|---|---|---|---|---|
| 9,296,363 | B2 * | 3/2016 | Pihlblad | F26B 25/06 |
| 2002/0158209 | A1 * | 10/2002 | Ueno | B05D 3/0209 250/455.11 |
| 2010/0088921 | A1 | 4/2010 | Bergaglio | |
| 2013/0095274 | A1 | 4/2013 | Jones | |
| 2015/0068057 | A1 * | 3/2015 | Pihlblad | F26B 25/06 34/245 |

FOREIGN PATENT DOCUMENTS

| | | | |
|---|---|---|---|
| EP | 1167138 | A1 | 1/2002 |
| WO | 2006/010301 | A1 | 2/2006 |
| WO | 2013/095274 | A1 | 6/2013 |

* cited by examiner

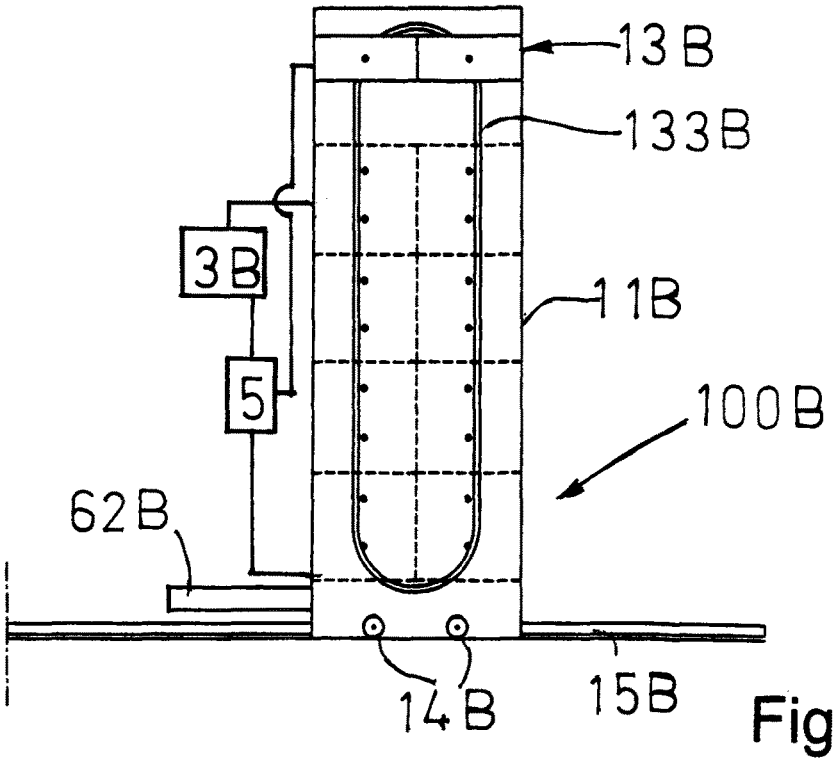
Fig. 7B
Fig. 8
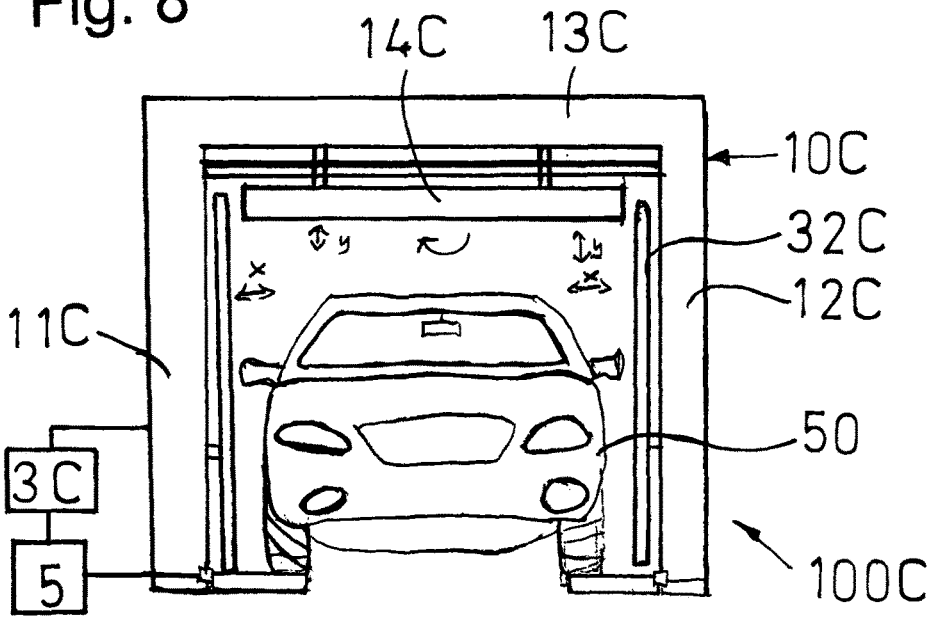

Fig. 11
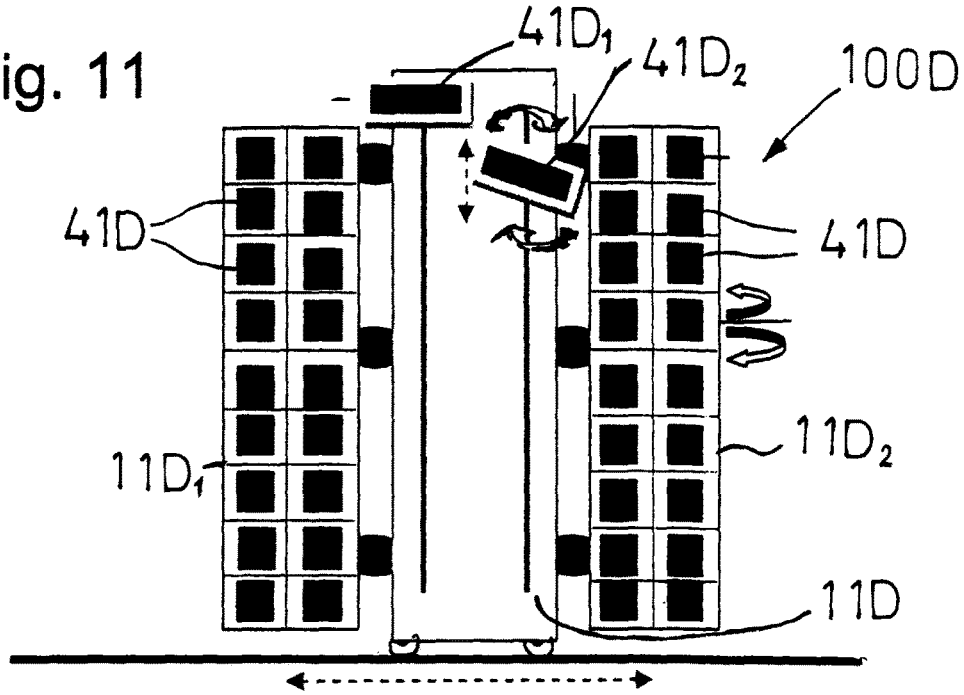
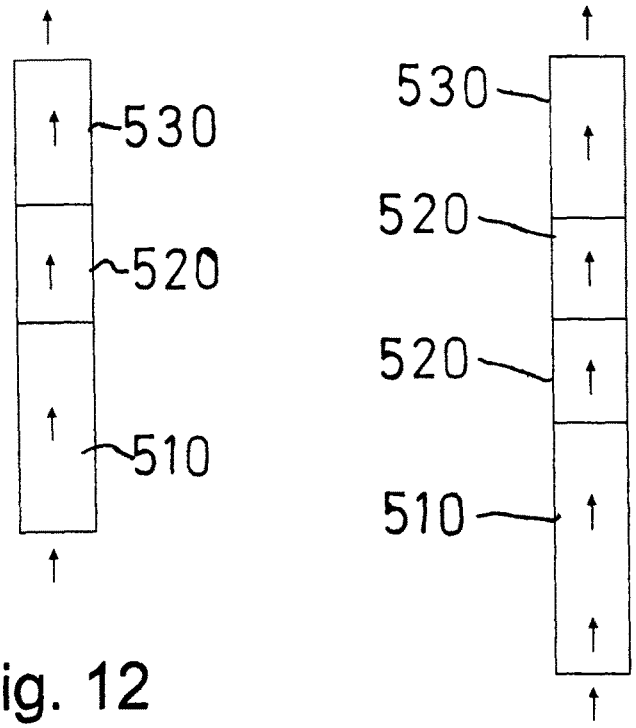
Fig. 12

DEVICE FOR, OR IN, THE SURFACE TREATMENT OF OBJECTS

TECHNICAL FIELD

The present invention concerns a device for the surface treatment and/or for the use in connection with surface treatment of an object, for example a vehicle, arranged on a workstation surface, having the features defined in the first part of claim 1. The invention also concerns the use of such a device in connection with surface treatment of a vehicle. Particularly, the invention concerns a device to be used in the repair treatment of a vehicle, in particular in jobs using UV curing products.

BACKGROUND

Many different methods are known to be used in the painting cars or greater or smaller body parts or something else. A particular field concerns so-called repair treatment, which may consist of hammering, puttying, general touch-up works, clear varnish painting.

Painted vehicles or vehicle parts have to be cured and dry. A much used method consists of transferring heat, for example by convection, to the treated vehicle, or the part. It mostly comprises generating a flow having a high temperature, which is directed toward the vehicle/part. Known devices comprise a drying oven or a booth in which the vehicle/part is placed. Disadvantages of such proceedings are that they are very energy- and time-consuming. Drying and curing, respectively, may in principle occur in room temperature, but may then take up to a day. The drying procedure and the curing procedure, respectively, can be speeded up by drying in a plant as described above, at a temperature of approx. 60°, and the drying time can then be reduced to maybe between half an hour and one hour. But also this is to be considered as a very long time in the context and involves high costs because the throughput time for a vehicle or a vehicle part becomes very long and a large area is blocked.

In order to avoid the complex of problems of time and blocked area, it has become common, where possible, to carry out surface treatment of body parts or minor damage by IR irradiation to accelerate the drying. In doing so, a basecoat has first been applied, airing has been effected, after which a clear varnish has been applied, which has been allowed to dry under IR irradiation for 20-25 min. Also this involves relatively long drying/curing times.

It has also been proposed to, for particular materials, carry out the curing in two steps, a first with radiation curing by UV light, and then at a temperature of between 130°-200°, alternatively in room temperature (EP-A-0 000 407).

EP-A-0 826 431 suggests a proceeding wherein, after short drying or curing of a basecoat layer either for 3-10 min at a temperature of 40° -80° or IR drying for 3-6 min, a clear varnish layer is applied, which is dried by pulsed high-energy UV irradiation with a high-energy UV flash lamp.

Also this proceeding is time-consuming and intended for the treatment of minor damage or small parts.

It should be noted that plastic components, e.g. bumpers, may be deformed if too high temperatures are used. Plastic may be deformed at temperatures of above approx. 75°.

US 2010/0088921 discloses a device for drying a painted vehicle, which comprises panels at a workstation or a booth with IR radiation sources emitting IR radiation and having two different emission spectra, which among other things is attained by blowing a mixture of compressed air and oxygen toward a catalytic panel.

U.S. Pat. No. 4,416,068 discloses a device consisting of a repair booth to hasten drying and/or curing in connection with touching up a car. IR sources and heat radiating elements are arranged in such a way that their positions and orientation can be selected in a suitable way. In spots difficult to access, reflectors are utilized. The IR sources are arranged in horizontal or vertical groups or rows of a ceiling mounted structure moving reciprocally above the car. A uniform temperature distribution is aimed at, wherein the drying time can be reduced. However, this device does not work optimally neither what concerns speed or quality of the processing nor the working environment. In addition, the energy consumption becomes high since IR as well as heat irradiation are utilized. Another disadvantage consists of the entire plant shaking when moving along railings in the ceiling. Again another disadvantage then arises, since all painting work is highly susceptible to dust and dirt, the ceiling mounting makes that dust, etc. easily is accumulated in nooks and the like above the object, and may fall down onto the object, to an even greater extent as a fan is utilized to blow air toward the reflectors.

Generally, the curing, when using traditional clear varnish, takes approx. 30-60 min. After curing, the clear varnish is very sensitive for a couple of days and difficult to handle.

The requirements of speed and homogeneous curing and drying are particularly high what concerns the use of substances having lower content of solvent or water-based substances cured by UV light. Thus, no one of the devices known hitherto works fully satisfying neither what concerns speed, energy consumption, quality, simplicity nor environment-friendliness.

SUMMARY OF THE INVENTION

Therefore, it is a goal of the present invention to provide a device by which one or more of the above-mentioned problems are solved. Particularly, it is a goal of the invention to define a device for the surface treatment, particularly drying and/or curing, of an object, for example a car, by which the access across the entire object becomes extraordinarily good and even, which is quick, and which gives a very good result.

Even more particularly, it is a goal to define a device by which it becomes highly advantageous and is facilitated to use substances with a smaller amount of solvents, particularly UV curing substances such as UV sanding sealer, UV putty, UV clear varnish. Particular goals of the invention are to define a device by which surface treatment can be made in an environmental-friendly way, which allows less discharge of hazardous substances in total and also less discharge of substances harmful to the staff working at the plant, and which in addition is environmental-friendly and inexpensive in operation in that the energy consumption is low.

It is a goal to define a device, which in various ways facilitates the use of substances more harmless to the environment, which is quick, allows a simple logistics, short durations of treatment, and is simple and safe to handle. Another goal is to provide a device, which is flexible, simple to install and maintain, by which in addition the material consumption, i.e., regarding surface-acting agents, can be held low and be reduced in relation to methods used today.

It is also a goal to define a device and a proceeding, respectively whereby an object after curing is not as sensitive as in known treatments, but in an easier way can be handled, recoated, etc.

It is also a goal of the invention to define a use of the device and a proceeding, respectively, whereby one or more of the above-mentioned goals can be achieved.

Therefore, a device is provided as initially has been indicated having the features defined in the characterizing part of claim 1.

There is also provided a use.

Advantageous embodiments are defined by the features defined in the dependent claims.

It is an advantage of the invention that there is provided a device which makes possible a quick surface treatment of objects, particularly cars, in particular in repair jobs, but which also can be applied in jobs included in a production chain, which allows a high rate of production. In repair jobs, it will in many cases be possible to completely take care of most damage in approx. 30-40 min and a high rate of production can be maintained. It is also an advantage that the energy consumption can be essentially reduced, particularly up to approx. 40%. By the quick treatment, optimum use of products having a low content of solvent is made possible, which also results in the emission of harmful substances decreasing and can in advantageous cases be reduced by as much as up to 70%.

Another advantage is that there is provided a device which easily can be integrated in a plant in which different types of jobs can be carried out.

It is also an advantage that there is defined a device which is clean and decreases the risk of contamination and dust spreading, which is of utmost importance in order to obtain a good result in different types of surface treatments. Another advantage is that there is defined a device which particularly is advantageous in the use of UV curing products, but which also gives significant advantages as discussed above also when using more conventional products.

It is an advantage that the energy consumption as well as the consumption of material can be essentially reduced, as well as that new substances more harmless to the environment, for instance varnishes, which nevertheless are particularly sensitive upon curing and normally require longer curing time, can be treated quickly, accurately, and efficiently.

It is an advantage that there is provided a device/a proceeding which makes that, for instance, a cured object, e.g. a car, does not become as sensitive as in conventional treatments, and can essentially immediately be handled, recoated, etc.

BRIEF DESCRIPTION OF THE DRAWINGS

In the following, the invention will be described, in a non-limiting way, and with reference to accompanying figures, in which:

FIG. 8 is a view from the front, which schematically shows a third embodiment of a device according to the invention, FIG. 11 is a schematic side view of a side section according to a fourth embodiment, and FIG. 12 shows very schematically an example of a treatment plant comprising a device according to the invention.

DETAILED DESCRIPTION

Figure 1:
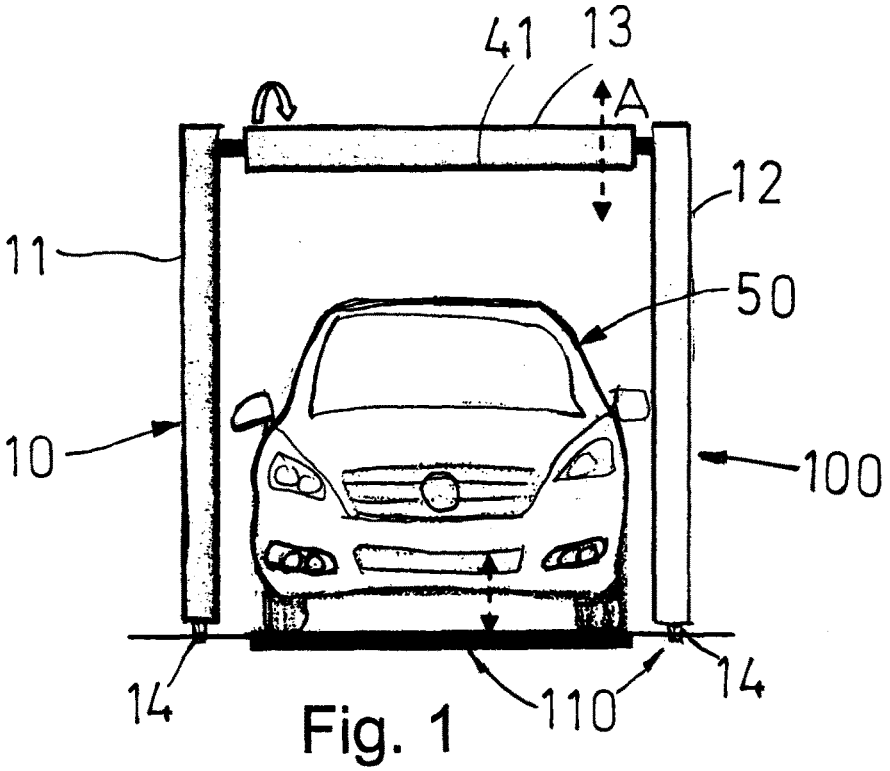
FIG. 1 schematically shows a side view of a device according to a first embodiment of the invention.

FIG. 1 shows a first embodiment of a device 100 for the use for the surface treatment of, here, a car 50. The proper surface treatment may be of different types but consists particularly of drying/curing in connection with car painting, particularly in repair jobs and, in advantageous embodiments when, for instance, so-called UV clear varnish, UV sanding sealer, or UV putty has been used, i.e., compounds wherein the amount of solvent is reduced, in certain cases by up to 50-70%. The device comprises a support frame structure 10, where the entire structure is movably arranged, at least in a direction in relation to the object 50 (see dashed arrow B in FIG. 3).

The support frame structure 10 comprises two parallel side or leg sections 11, 12, which are fixedly or detachably, but movably, arranged at or in a workstation surface 110, or more generally on a floor surface, which either may be considered to be included in the device or on which the device is placed, and which is formed with tracks or rails or the like for the device 10 to be movable in accordance with the arrow B as described above.

In alternative embodiments, not shown here, the support arm structure 10 may be formed so that the side sections 11, 12 can be movable also in a direction perpendicular to the arrow B in order to be placeable in a limited number of different positions so as to, in such a way, control the width or distance between the side sections 11, 12 for adaptation to different object sizes. On that occasion, also co-operating structure, tracks or the like in the floor or the workstation surface have to be adapted thereto.

In an advantageous embodiment, the side sections are connected with a transverse upper, intermediate section 13. If the side sections 11, 12 should be adjustable or movable also in, for example, a direction transversal, i.e., perpendicular to the arrow B, or any other suitable direction, in order to be set into different job positions, the upper intermediate section has to be either adjustable longitudinally, extensible, or replaceable so that different sections can be used depending on the distances to be used between the side sections or be connected only with one of the side sections.

Figure 2:
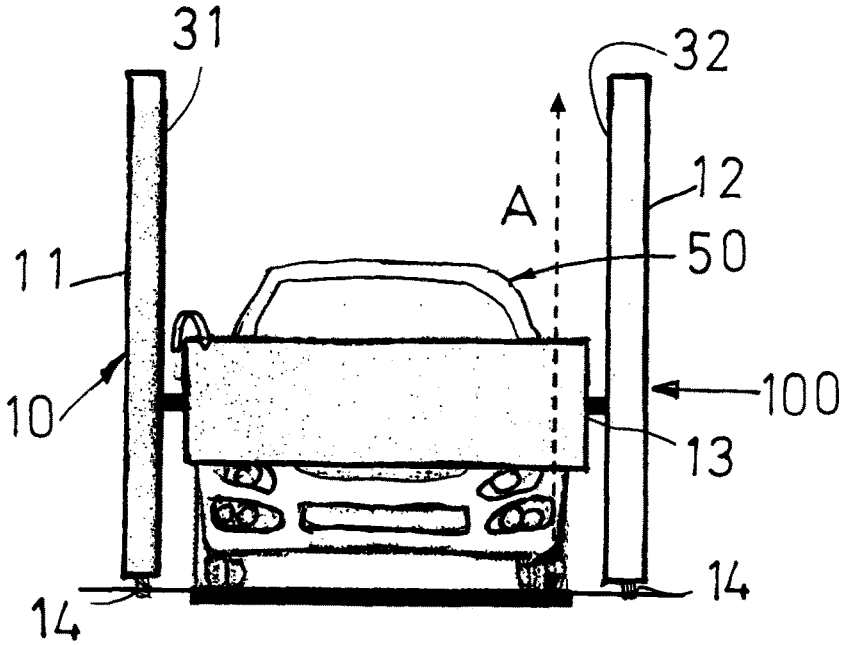
FIG. 2 is a schematic view of the device in FIG. 1 from the front with an upper intermediate section in a first position above an object.

The upper intermediate section 13 is arranged to be vertically adjustable according to arrow A in FIGS. 1 and 2, which can be achieved in various ways, for instance it may be mounted on a side section, for example by means of a running chain or in another suitable way. The side sections 11, 12 as well as the upper section 13 are provided with the respective panels 31, 32, and 41, respectively, in such a way that the panels 31, 32 essentially face each other and the object to be treated, while the upper panel 41 is rotatably or turnably arranged on a shaft included in the upper section 13 so that the panel during movement of the support frame structure along the object 50 can turn so that it constantly is essentially perpendicularly positioned to the part of the object to which it is closest situated.

Sensor elements 40 are arranged on different spots to sense where the closest surface of the object is situated during the movement of the support frame structure 10 along and surrounding the object so that the panels always will be situated at a desired distance from the object or within certain prescribed limits. Preferably, said distance is between 15 and 20 cm or even smaller. It may be set, for example, via a control unit to which also the sensors are or can be coupled (not shown in FIG. 1).

The panels 31, 32, 41 are provided with a number of irradiation elements 70, 71, which only are schematically illustrated in the figure. Said irradiation elements consist of UV lamps 71 and IR lamps 70. Preferably, the number of UV lamps exceeds the number of IR lamps. By the combination of UV as well as IR lamps, an extraordinarily good curing and drying effect is achieved, which gives an even homogeneous effect with a good luminous flux and distribution from different angles.

In one embodiment example, the power of the UV lamps is 100 W at approx. 3 cm distance. The better the contour of the object can be followed at an even, desired short distance, the better the effect will be. In an advantageous example, UV flash lamps are utilized, which makes that the drying/curing process can be made very quick and come down to maybe 2 min if so-called UV products are used. It should be appreciated that the invention is not limited to any particular power, but 100 W is given only for exemplifying purposes.

The UV and IR lamps may be arranged in various ways, for instance alternatingly or with a certain periodicity, for instance a row of UV lamps followed by a row of IR lamps and so on. They may also be arranged in other ways, for instance exclusively UV lamps may be used where more even surfaces are to be treated that do not change direction fast or where there are small nooks and so on, and more IR lamps where the surfaces vary more, where there are many nooks, many and/or large direction changes, etc. since the IR lamps have a higher temperature, which makes that the access is further improved. The heat produced by the use of the IR lamps in addition to the UV irradiation also generally contributes to an improved curing/drying. Many different variants are possible here. (In certain variants, no IR lamps are used). The arch (the side sections and the intermediate section), may, but does not have to, be made of aluminium or sheet-metal and be provided with reflectors for lamps/fluorescent tubes.

In one embodiment, an object is cured by UV and IR irradiation to approx. 75°, for approx. 5 min. It should be appreciated that these indications only are given with an exemplifying and not limiting purpose.

Figure 5:
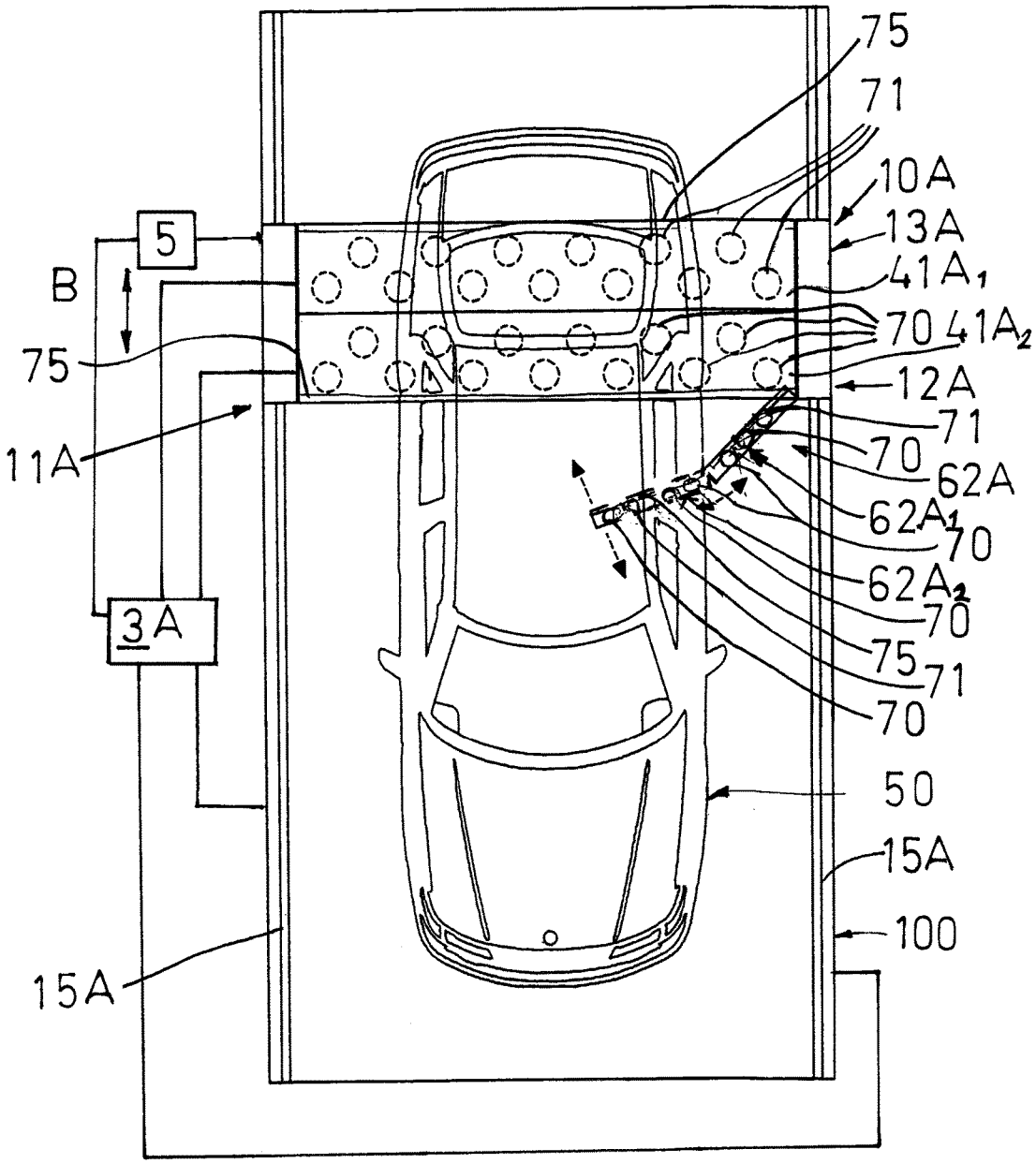
FIG. 5 shows the device in FIG. 4 as seen from above.

The panels 31, 32, 41 are advantageously controlled by the control unit 3 (only schematically shown in FIG. 5 as coupled to the wall sections as well as to the intermediate section, and panel, respectively, which should indicate that it registers signals from individual sensor elements, controls lamps, panels, and the different sections via one or more motors). Hence, the control unit registers signals from the sensor elements and controls the panels depending on these signals when the support frame structure 10 as here can be said to consist of an arch moving to and fro along the object 50. The control unit is programmed for the respective type of object, or individual object, for instance, different passenger cars, and is coupled to said sensors, which sense obstacles and distance to the object, respectively. During movements to and fro along the car (arrow B), the upper section 13 is raised and lowered with the panel 41 according to arrow A at the same time as the panel 41 (alternatively the upper section 13) can be turned and rotated so that the side of the panel, which is equipped with at least UV lamps, can be rotated at least 90° or plus minus 50-60° during movement along the arrow B.

The panel 41 may, of course, be formed in various ways, it could also be formed as a cylinder, which surrounds a shaft forming the upper intermediate section 13, which is provided with irradiation elements across the entire surface or it may be semicircular, elliptical, or in principle assume any suitable shape on the assumption that the irradiation elements or the panel on which they are mounted can be turned and rotated so that they are constantly directed toward the closest surface of the object where they/it are/is situated. Preferably, also the side panels 31, 32 are arranged so that they can move, turn, toward the object 50 in the panel position in question in relation to an object during the movement along the object.

This can be achieved if the panels are arranged at, or connected with, the side sections 12, 13 in such a way that they can be pushed out and in, for instance by means of piston type cylinders or the like.

In an advantageous embodiment, they may also be vertically adjustable and may, for instance, be angled in one or two directions orthogonal to the direction of extension along arrow B. This is not shown in FIG. 1 or 2, but can be achieved in various ways. In the figure, neither it is shown that the side panels 31, 32 can individually be divided and, for instance, comprise separate upper and lower panels or consist of a number of panel elements, either only vertically or vertically as well as laterally.

According to an advantageous embodiment, the treatment may take place in such a way that the support frame structure 10 moves slowly forward while the panels are activated and the upper panel 41 is lowered, either separately or also the entire upper section 13, in order to follow the contour of the car 50 to, for instance, cure applied clear varnish.

A motor 5 (schematically shown in FIG. 5), which drives the upper section may be an electric motor but driving may also be pneumatically effected or by hydraulics. Either a common motor may be used for driving the entire support frame structure as well as sections and/or the panels. Alternatively, more than one motor may be used, for example different motors for different functions. According to different examples, the support frame structure is driven on railings or in tracks in the floor surface or the workstation surface. Driving may be effected by means of a linked chain in the floor according to one embodiment. In certain preferred embodiments, the side sections are formed in such a way that desired shape, amount, size of panels can be adapted and exchanged, i.e., panels can be exchanged, added, or removed depending on needs, but it is advantageous that they are replaceable also for other reasons, for instance if one or more panels would break down. In this adaptability, it is then preferably also included that it would be possible to easily vary the illumination with UV and IR, respectively, by replacing a panel having, for instance, many UV lamps with a panel having more IR lamps or vice versa, or altering how different panels and/or lamps are arranged in relation to each other or depending on objects. Many variants are possible. The sensors may advantageously be builtin into the respective sections to sense the distance to the object as well as obstacles. Many variants are possible.

Preferably, the upper panel, or panels, can be raised, lowered, turned, and rotated, for instance 90°. The panel or the panels may either be vertically adjustable, or the entire intermediate section to which it or they is/are mounted.

FIG. 2 shows the device 100 with the upper intermediate section 13 in lowered position after the support frame structure has been moved forward along the object. In an alternative embodiment, not shown, the support frame structure could be fixedly arranged, for instance in a floor surface, while a platform on which the object is placed moves forward and the upper intermediate section or the panels move as has been previously described in respect of turning and rotation, respectively, as well as the side panels of the side sections.

Figure 3:
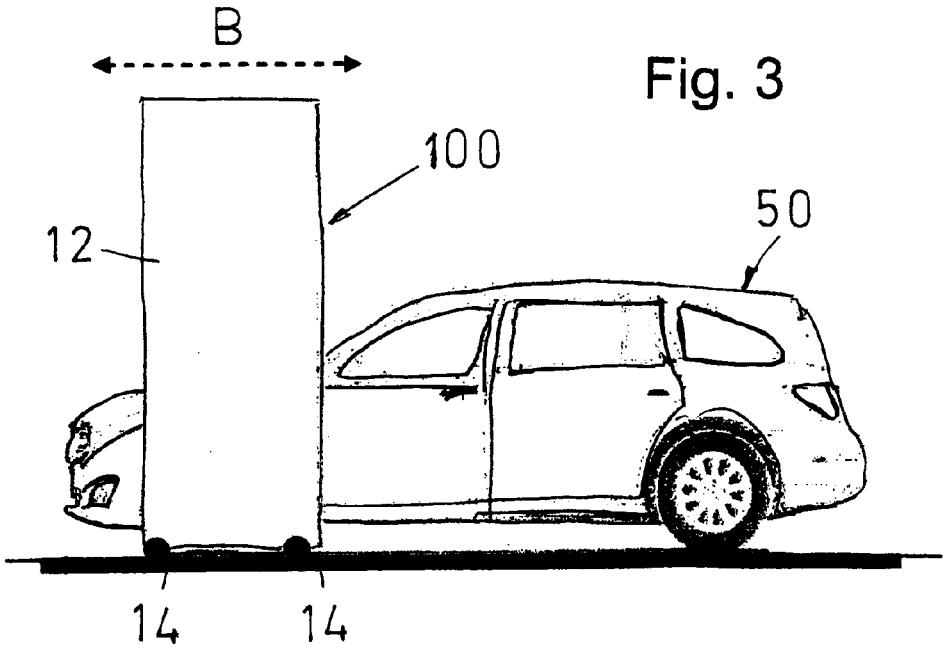
FIG. 3 is a view of the device as in FIG. 2, but with the upper intermediate section in another position upon treatment of an object.

FIG. 3 shows the device 100 as seen exteriorly from the outside of side section 12. The arrow B shows how the side section 12 moves, here by means of wheels 14.

Figure 4:
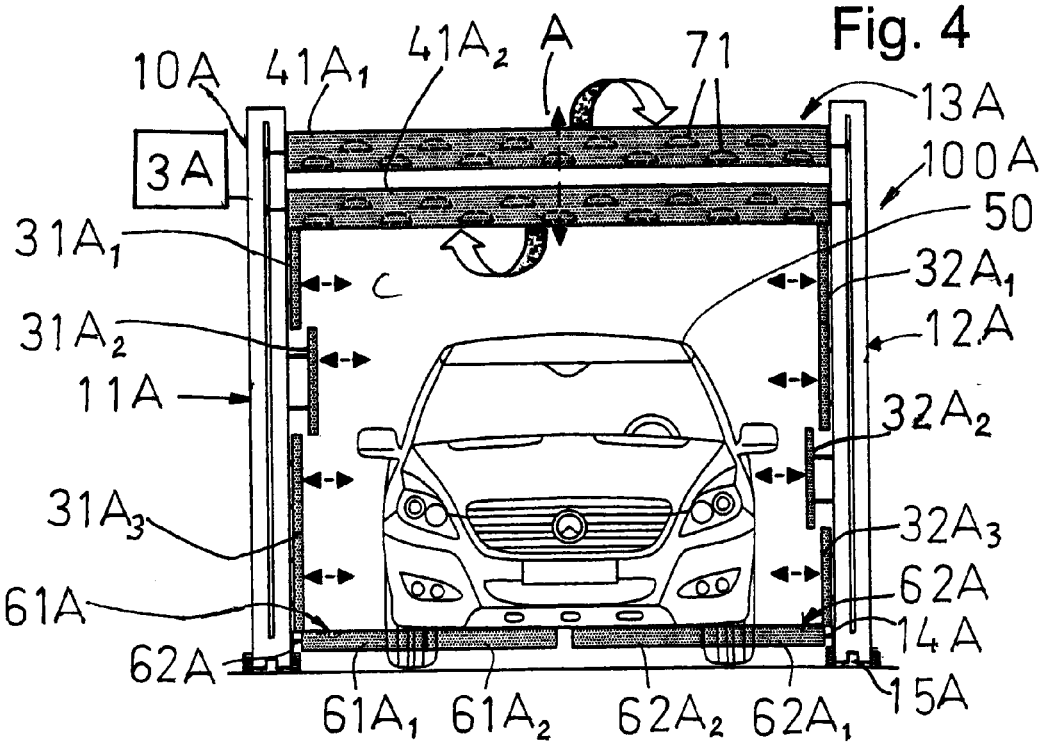
FIG. 4 shows an alternative, second, embodiment of a device in a view from the front with an object in treatment position.

FIG. 4 shows an alternative embodiment of a device 100A of the invention, comprising a support frame structure 10A having a first side section 11A, and a second side section 12A, and an upper intermediate section 13A. In the embodiment example that has been described with reference to FIGS. 1-3, the support frame structure is movable in the longitudinal direction along an object 50 placed on a floor surface or on a workstation surface along the arrow B in FIG. 3. It can move on railings or in any suitable way. In the example shown, it is guided and held in place by parallel, longitudinal railings 15A, 15A and is rolling on wheels 14A, 14A, which are arranged in pairs at the outer ends of the lower part of the respective side section or in another suitable way along these.

In the example shown in FIG. 4, three panels 31$A_1$, 31$A_2$, 31$A_3$ are arranged at the first side section 11A in such a way that panel 31$A_1$ is arranged at the top of the side section, panel 31$A_2$ is arranged underneath the uppermost panel 31$A_1$, and the lowermost panel is arranged at the lower half of the first side section 11A. Correspondingly, three panels 32$A_1$, 32$A_2$, 32$A_3$ are arranged at the second side section 12A.

The respective panels may be arranged at the respective side sections, for instance, by driven pistons or the like, which may be driven by a motor, for example be driven electrically, hydraulically, or mechanically depending on signals from sensor elements, which show or give indication of nearness to the object to be treated during the movement of the support frame structure 10A along the object as described above.

Preferably, the movements of the respective panels are driven entirely separately from each other. In advantageous embodiments, the panels may also be angled, which, for instance, may be achieved by they being provided with pistons or other control members that can be controlled separately so that, for instance, the panels shown in FIG. 4, which are arranged on a level with the object where the same has sloping sides, can be adapted according to these respective slopes so that the distance to the object becomes essentially the same during the movement of the support frame structure in relation to the object, or vice versa.

Alternatively, or as another alternative, there may also be arranged separate lateral members, e.g. pistons, formed to make possible angulation in various ways in the direction of movement of the support arm structure in order to, in such a way, be able to ensure adaptation to the contours of the object.

Panels may be arranged in many different ways, several panels vertically and/or several panels beside each other at the same or different heights from the floor surface or the workstation surface. Alternatively, or in addition, only certain panels are insertable and projectable and/or angleable in one or more directions.

In the example shown, the upper section 13A is provided with two panels 41$A_1$, 41$A_2$, which, for instance, but not necessarily, in addition to the same being lowerable with the upper section 13A, i.e., can be raised and lowered depending on where the upper section is situated in relation to the upper surface of the object to be treated during its movement along the vehicle, which is shown as A in FIG. 4, also can be raised/lowered in relation to the object. The panels can be rotated 90° or at another suitable angle, as schematically illustrated in the figure, so that, depending on position, the one or the other panel gets closest to the upper surface of the object. The panels may also be rotatably journalled to the upper section in a suitable way, and the upper section may be brought to rotate on a shaft as well as on a centre axis of the upper section 13A.

As previously described, the upper section 13A be may formed in various ways. The panels may be mounted in various ways and there may also be more than two panels, there may also be two or more panels arranged beside each other, i.e., each panel 41$A_1$, 41$A_2$ may be divided into one or more panel elements.

Even if UV lamps and IR lamps are shown as if they would have the same size, this is for certain possible, but not necessary in any way, but they may have different sizes. Also mutually, different UV lamps may have different sizes as well as different IR lamps may mutually have different sizes, all determined by needs, size, shape, presence of nooks, etc. on the spot that is to be treated by the respective lamp. It is also preferably possible to replace lamps, type as well as size.

At the bottom, the two side sections 11A, 12A are provided with arms, which are rotatably journalled to the same via connection elements 62A and which are mounted in such a way that the arms 61$A_1$, 62A1 can be turned inward toward the respective side section element to assume a position in which they are not active, and be turned out to assume another position in order to, for instance, irradiate an object (a car) from below, on one hand between front and rear wheels, and on the other hand in front of front wheels and behind rear wheels, respectively. Preferably, the movement between the two outer positions may take place variably, so that in principle any desired position can be assumed. Alternatively, the position setting can be such that only a number of discrete positions can be assumed.

Preferably, the arms are split and individually comprise outer and inner arm elements 61$A_1$, 62$A_1$ so that an inner arm element is connected with the respective side section and in the opposite end connected with each a respective outer arm element 62$A_1$, 62$A_2$. Preferably, also these connections between inner and outer arm elements are articulated so that an outer arm element can be folded toward an inner arm element and accordingly be folded inward toward the respective side section and be brought to make a movement under the car that is adapted according to where radiation should take place and also further improve the access and give an extended reach so that areas can be reached also behind, for instance, wheels on the surfaces bordering to the inside thereof. The arms may alternatively comprise more than two arm elements.

Preferably, also the arms are provided with sensors even if this is not always necessary. The arms are equipped with UV as well as IR lamps.

Compared with on panels bordering to larger regular surfaces, according to certain embodiments, the number of IR lamps in relation to the number of UV lamps is greater on the arm sections than on other sections or panels considering that under cars, the surfaces are often more irregular and have more nooks and so on.

The driving of panels and sections and of arms/arm sections, respectively, may effected via a common motor or by means of different motors in various ways. The movement of panels and of arms, arm sections and arm elements, respectively, is controlled by sensors and signals to one or more control units, which in turn control the motor or the respective motors.

FIG. 5 shows the device 100A in FIG. 4 as seen from above with an object (a car) 50 placed between the side sections and under the upper section 13A when the support arm structure 10A is situated above the rear part of the car. The panels 41$A_1$, 41$A_2$ included in the upper section 13A are here situated in a position beside each other, i.e., they are not rotated. Arm 62A having inner and outer arm elements 62$A_1$,62$A_2$ is journalled to side section 12A and partly angled out so that the outer arm section or arm element 62$A_2$ thereof is situated under the car, between front and rear wheels on one of the sides. The side sections of the support frame structure are running in railings 15A. Sensors may be particularly implemented as floodlight sensors 75, which are arranged along the panels (in FIG. 5 schematically shown on the arm sections 62$A_1$ 62$A_2$). It should however be appreciated that floodlight sensors also are correspondingly implemented along the panels of the side sections. The sensors detect distance to the object, e.g. where the arch is situated, and sense obstacles, for example wing or side mirrors, and deliver signals to the control unit, which, via one or more motors, controls the position, direction, etc. of the panels in relation to the object, and ensure that obstacles, such as projecting objects, can be avoided.

The control unit 5 is placed outside the proper box, on or adjacent to the outside of a side section or in any suitable location; it may also be arranged remotely from the proper box in an operator position or any other suitable spot. In FIG. 5, it is shown how it is coupled to a common motor 3, which controls the respective panels. Alternatively, separate motors may control one or more panels and/or sections. The control unit may comprise an operator's console unit for programming what the UV/IR device should do, for instance, cure the left front door, boot cover, etc. It may, for instance, comprise a touch panel where different parts may be indicated.

In the example shown, reference designation 71 indicates UV lamps, which here are arranged on panel 41$A_1$, while IR lamps 70 are arranged on panel 41$A_2$. In other embodiments, they are arranged in other ways, for instance in groups on one and the same panel, in different rows within one and the same panel, every second lamp is an IR lamp, every third or every fourth lamp is an IR lamp, or in any desired way. In FIG. 5, UV lamps 71 and IR lamps 70 are alternately arranged on the arm sections, somewhat more IR lamps than UV lamps owing to there being many nooks under the car.

Figure 6:
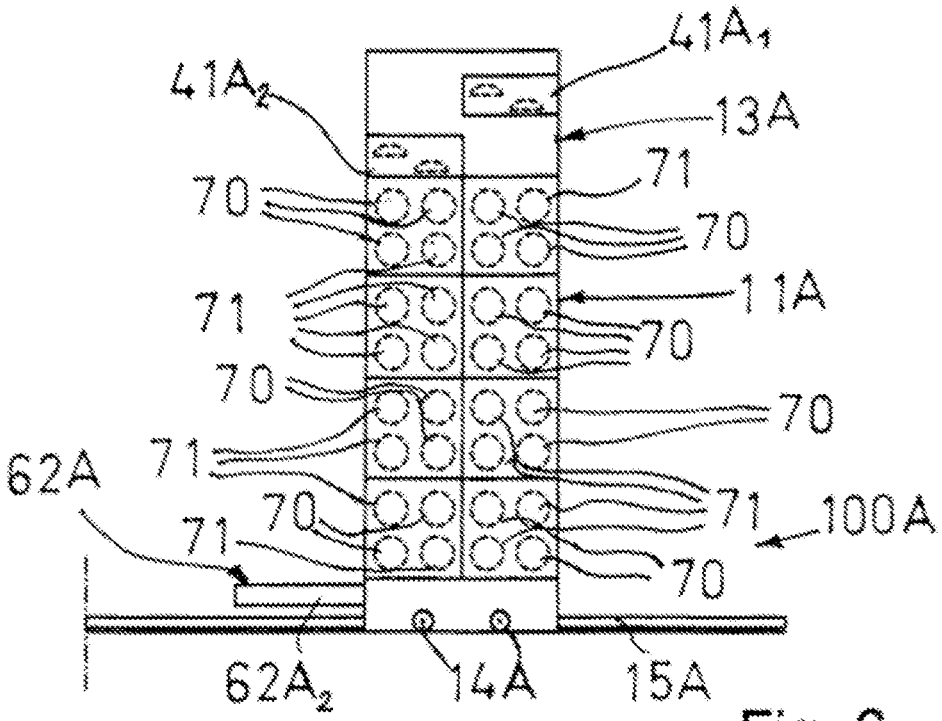
FIG. 6 shows a side section of the device in FIG. 4 as seen from inside according to one embodiment, FIG. 7A schematically illustrates an embodiment of a side section of the device in FIG. 4 as seen from outside.

FIG. 6 shows a side view of the section element 11A as seen from inside, i.e., from the object side and shows an example of here eight separate panels on which UV lamps 71 and IR lamps 70 respectively, are arranged. The arm 62 is angled out in a direction so that it is located essentially parallel to railing 15A and the outer arm section 62$A_2$ is visible. The inner arm section is concealed by the lower part of the side section 11A. In the figures, it is schematically shown how the two panels 41$A_2$, 41$A_1$ are arranged in relation to each other in a section on a level with the inner side of the side section 11A.

Figure 7A:
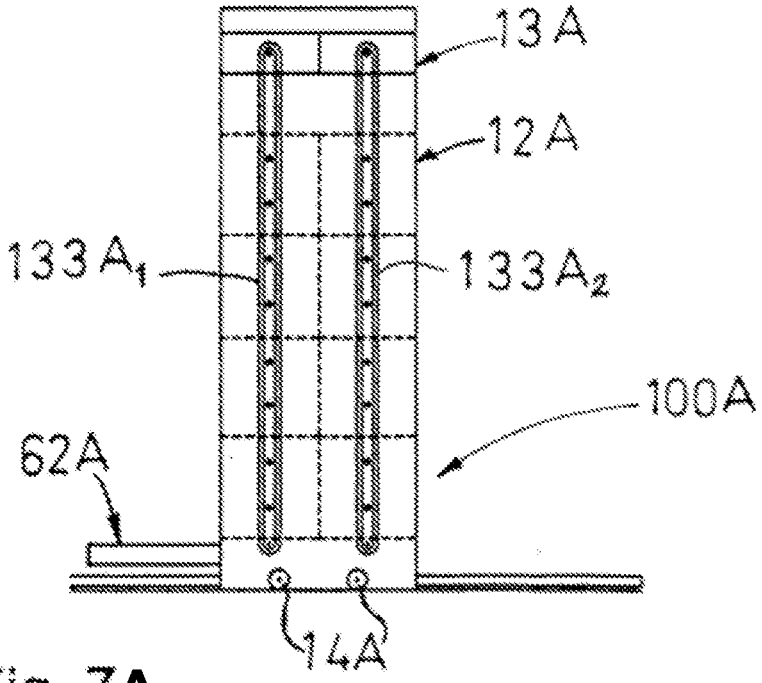
FIG. 7B is a view from outside of an alternative embodiment of a side section.

FIG. 7A shows side section 12A as seen from the outside in an embodiment corresponding to the one shown in FIG. 6 with eight panels. In the figure, it is schematically shown how the upper section 13A with the panels (or in an alternative embodiment of the panels separately arranged) is driven by means of the respective linked chains 133$A_1$, 133$A_2$ by means of which the vertical location of the panels and their turning can be controlled. As previously mentioned, they may be driven pneumatically, hydraulically, or by an electric motor. It should be evident that the number of panels on the side sections as well as on the upper section may be varied. Preferably, between two and six panels are used on the upper section.

FIG. 7B shows a side section 12B according to an alternative embodiment of a device 100B, which in other respects may be formed as previously described. A common chain 133B is used to drive the upper panels by driving the upper section 13B. In other respects, this corresponds to the embodiment example that, for instance, has been described with reference to FIG. 4.

Figure 9:
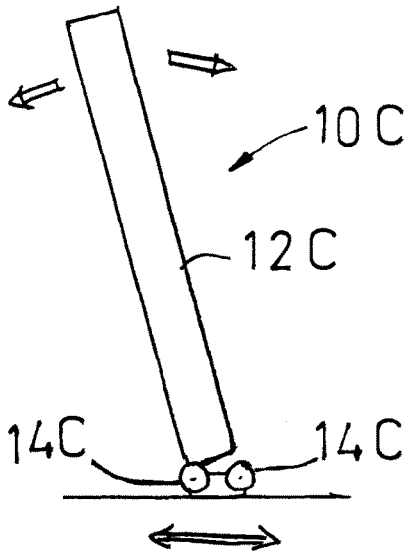
FIG. 9 is a schematic view from the side of a side section, which is included in the device in FIG. 8.
Figure 10:
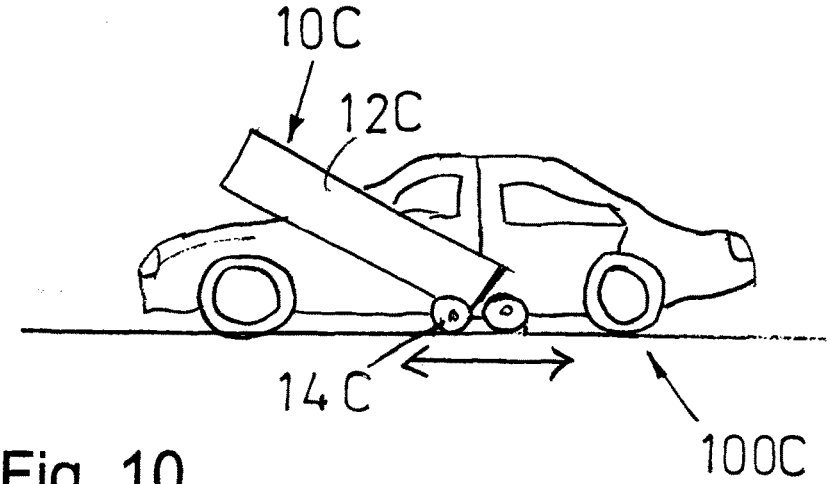
FIG. 10 is a side view of the device in FIG. 8 with an object under treatment.

FIG. 8 shows once again another alternative embodiment of a device 100C according to the invention. Here, the support frame structure 10C comprises an arch consisting of two parallel side sections 11C, 12C, at which side panels 31C and 32C, respectively, are arranged in such a way that they can be displaced inward toward and away from an object, particularly also be angled in relation to, for instance, a car 50 as previously described, in the direction of the arrows X. The upper intermediate section 13C is also provided with an upper panel 41C (which like earlier embodiment may be divided into one or more panels), which can be turned and/or rotated and also be lowered and raised in accordance with the arrows in the figure. However, this embodiment differs in that the support frame structure 10C is rotatably journalled to a bottom surface or a floor surface, see FIG. 9, and that it can be angled down and turned around the centre of rotation of a shaft, which in the example shown is indicated by a wheel shaft 14C on which the support frame structure 10C is journalled. In a particular embodiment, the arch forming the support frame structure may also be moved to and fro in the direction of the arrow A. By the fact that the entire arch can be turned down, the movement may not/does not need to be so long. In other respects, the device functions in such a way that has been previously described and may be varied correspondingly what concerns driving, arrangement of sensor elements, control unit, motor, and arms, etc.

FIG. 11 shows very schematically a further alternative embodiment wherein, on each side section 11B (here only one side section shown), outer edge sections 11$B_1$, 11$B_2$ are turnably journalled by, for instance, hinges and provided with panels, which may be formed in various ways and be angled inward toward an object. Particularly, the lamps (UV and IR, respectively) may be arranged as light panel cells, which can be pushed in/out in a suitable way. The side sections may also be provided with UV/IR panels 41$B_1$, 41$B_2$, which may be arranged so that they can be displaced up and down along the side section, as well as be turnably and rotatably journalled. Like in previous embodiments, one or more upper panels are vertically adjustable and rotatably journalled, respectively, at an upper section. An advantage of this embodiment may be suitable in the treatment of buses, vans, etc. having high, long side walls.

Finally, FIG. 12 shows very schematically what a plant comprising a device according to the invention could look like. The arrows in FIG. 11 indicate, for instance, cars. In contrast to known plants, where corresponding jobs are carried out, the objects, which consist of cars in the described example, are moved constantly forward in one direction and pass from station to station (here, for instance, from workstations 510 to painting boxes 520 and then to curing ovens 530), which differs from previously known plants, and which is extremely advantageous since a higher rate of production can be achieved at the same time as less area or space is required and waiting times for the objects can be minimized, organization and logistics be facilitated. Cars are standing lengthwise instead of crosswise as in known devices, and cars do not have to be moved several times, which is a significant advantage.

The invention claimed is:

1. A device for surface treatment of an object arranged on a workstation surface, comprising:

an arch-like support frame structure movable in at least one direction in relation to the object, the support frame structure surrounding the object on at least two sides and having two substantially parallel and movable side sections and an upper section connected with at least one of the side sections;

a number of infrared (IR) and ultraviolet (UV) light sources arranged on the support frame structure, a number of sensors arranged in a plurality of positions to sense absolute or relative position and/or angle of the object, and a control unit coupled to the light sources and sensors and configured for selective irradiation of at least a portion of the object based on signals from the sensors;

wherein the side sections are configured for selective arrangement at a distance from each other such that the object, in at least one direction, is contained between the side sections and under the upper section;

each of the side sections includes at least one movable, adjustable side panel, and the upper section includes at least one movable upper panel;

the light sources are arranged on the panels, and at least one of the panels has IR and UV light sources;

the control unit is configured to control irradiation of the object by controlling position and/or angle of at least one of the panels, sections, and light sources in relation to the object; and the side sections include arms, the light sources are disposed on the arms, and the arms are rotatably journaled to the side sections such that when the arms are turned out from the side sections they irradiate the object from below.

2. The device of claim 1, wherein the upper section or the at least one upper panel is rotatably journaled to or adjacent to the side sections, and is rotatable or translatable by the control unit based on signals from the sensors to irradiate the object at a desired distance and/or direction by a selected light source.

3. The device of claim 2, wherein an at least one side panel is arranged at a side section by a setting member such that the side panel is movable toward and away from the object substantially perpendicularly or at a given angle in relation to a plane in which the respective side section extends.

4. The device of claim 2, wherein the side panels are turnably arranged at the respective side sections so that, depending on signals delivered to the control unit from the sensors, the side panels enable setting a desired irradiation angle.

5. The device of claim 1, wherein at least two arms are arranged on opposite side sections, and each of the at least two arms includes two or more telescopic or articulating arm sections.

6. The device of claim 1, wherein the IR and UV light sources are arranged on the panels in alternating rows and columns such that at least a plurality of the panels have both UV and IR light sources.

7. The device of claim 1, wherein the side sections are disposed on rails on the workstation surface.

8. The device of claim 7, wherein the side sections are simultaneously driven along the rails by a motor.

9. The device of claim 8, wherein the motor moves the panels in response to the control unit based on signals from the sensors.

10. The device of claim 1, wherein the side sections are turnably journaled in fulcrums of mounting elements such that the support frame structure is turnable about the fulcrums down toward a floor based on signals from the sensors.

11. A device for surface treatment of an object arranged on a workstation surface, comprising:

an arch-like support frame structure movable in at least one direction in relation to the object, the support frame structure surrounding the object on at least two sides and having two substantially parallel and movable side sections and an upper section connected with at least one of the side sections;

a number of infrared (IR) and ultraviolet (UV) light sources arranged on the support frame structure, a number of sensors arranged in a plurality of positions to sense absolute or relative position and/or angle of the object, and a control unit coupled to the light sources and sensors and configured for selective irradiation of at least a portion of the object based on signals from the sensors;

wherein the side sections are configured for selective arrangement at a distance from each other such that the object, in at least one direction, is contained between the side sections and under the upper section;

each of the side sections includes at least one movable, adjustable side panel, and the upper section includes at least one movable upper panel;

the light sources are arranged on the panels, and at least one of the panels has IR and UV light sources;

the control unit is configured to control irradiation of the object by controlling position and/or angle of at least one of the panels, sections, and light sources in relation to the object; and the device comprises more UV light sources than IR light sources.

12. The device of claim 11, wherein the UV light sources have a power of 100 watts at a distance of approximately 3 centimeters from the object.

13. The device of claim 1, further comprising a motor configured to move the support frame structure hydraulically or pneumatically.

14. A device for surface treatment of an object arranged on a workstation surface, comprising:

an arch-like support frame structure movable in at least one direction in relation to the object, the support frame structure surrounding the object on at least two sides and having two substantially parallel and movable side sections and an upper section connected with at least one of the side sections;

a number of infrared (IR) and ultraviolet (UV) light sources arranged on the support frame structure, a number of sensors arranged in a plurality of positions to sense absolute or relative position and/or angle of the object, and a control unit coupled to the light sources and sensors and configured for selective irradiation of at least a portion of the object based on signals from the sensors;

wherein the side sections are configured for selective arrangement at a distance from each other such that the object, in at least one direction, is contained between the side sections and under the upper section;

each of the side sections includes at least one movable, adjustable side panel, and the upper section includes at least one movable upper panel;

the light sources are arranged on the panels, and at least one of the panels has IR and UV light sources;

the control unit is configured to control irradiation of the object by controlling position and/or angle of at least one of the panels, sections, and light sources in relation to the object; and the upper section comprises two upper panels, each upper panel is disposed on a shaft and is turnable at a given angle on the respective shaft, and the shafts are vertically adjustable.

15. The device of claim 1, wherein the upper section comprises two or more upper panels.

16. The device of claim 14, wherein the shafts are journaled at a given distance from each other, and the upper panels are turned during shaft rotation so that the light sources are substantially continuously directed toward the object.

17. The device of claim 1, wherein at least two side panels are arranged at each side section at different heights, and the at least two side panels are movable substantially perpendicularly or at a given angle toward and away from the object.

18. The device of claim 1, wherein each side section includes between two and fourteen side panels.

19. The device of claim 1, wherein each of the side and upper panels has a width of approximately one-half meter to approximately one meter.

* * * * *